US007117685B2

(12) United States Patent
Wetherbee

(10) Patent No.: US 7,117,685 B2
(45) Date of Patent: Oct. 10, 2006

(54) DRINKING WATER COOLER

(75) Inventor: Jeffrey A. Wetherbee, Twin Lakes, WI (US)

(73) Assignee: On Course Solutions, LLC, Twin Lakes, WI (US)

( * ) Notice: Subject to any disclaimer, the term of this patent is extended or adjusted under 35 U.S.C. 154(b) by 186 days.

(21) Appl. No.: 10/913,770

(22) Filed: Aug. 7, 2004

(65) Prior Publication Data

US 2006/0026987 A1 Feb. 9, 2006

(51) Int. Cl.
*F25B 1/00* (2006.01)

(52) U.S. Cl. ..... 62/115; 62/389; 62/397; 222/146.6

(58) Field of Classification Search ..... 62/389, 62/391, 397, 388, 399; 222/146.6; 165/132, 165/163
See application file for complete search history.

(56) References Cited

U.S. PATENT DOCUMENTS

| | | | | | |
|---|---|---|---|---|---|
| 172,687 | A * | 1/1876 | Baeppler | 165/132 |
| 986,276 | A * | 3/1911 | Freeman | 165/163 |
| 1,078,214 | A * | 11/1913 | Patnaude | 62/397 |
| 3,824,801 | A * | 7/1974 | Laudato, Jr. | 62/201 |
| 4,204,613 | A * | 5/1980 | Terzian et al. | 222/146.6 |
| 4,407,356 | A | 10/1983 | DeLau | |
| 4,494,600 | A * | 1/1985 | DeLau | 165/132 |
| 4,723,688 | A | 2/1988 | Munoz | |
| 4,834,267 | A * | 5/1989 | Schroer et al. | 222/185.1 |
| 4,902,320 | A | 2/1990 | Schroer et al. | |
| 4,946,599 | A * | 8/1990 | Craig | 210/741 |
| 5,111,966 | A * | 5/1992 | Fridman | 222/1 |
| 5,232,125 | A | 8/1993 | Adams | |
| 5,295,519 | A * | 3/1994 | Baker et al. | 141/18 |
| 5,405,526 | A * | 4/1995 | Sutera | 210/124 |
| 6,230,513 | B1 | 5/2001 | Reinmuth | |
| RE37,696 | E * | 5/2002 | Parker | 62/3.63 |
| 6,442,960 | B1 * | 9/2002 | Fournier et al. | 62/390 |

FOREIGN PATENT DOCUMENTS

EP 1241127 * 9/2002

* cited by examiner

*Primary Examiner*—Mohammad M. Ali
(74) *Attorney, Agent, or Firm*—Ronald E. Andermann

(57) ABSTRACT

A cooler (100) for supplying cooled drinking water, particularly at remote outdoor locations, includes a reservoir (101) that supplies water to a conduit (119) for indirect cooling by a cooling medium, for example ice, contained in a container (105). A water bottle (103) is installed in the cooler (100) such that a feed tube (111) of the reservoir (101) penetrates and engages the hygienic seal (201) of the water bottle (103). The conduit (119) is connected to a discharge (113) on the reservoir (101) and a spigot (125). When the spigot (125) is opened, water passes through the conduit (119) and is indirectly cooled. As water is withdrawn from the cooler (100) at the spigot (125), air that replaces the withdrawn water enters the reservoir (101) through an air intake (115). The cooler (100) can have a filter (211) at the air intake (115) to prevent contamination by ambient air.

23 Claims, 3 Drawing Sheets

DRINKING WATER COOLER

CROSS-REFERENCE TO RELATED APPLICATIONS

Not Applicable

STATEMENT REGARDING FEDERALLY SPONSORED RESEARCH/DEVELOPMENT

The present invention does not involve any form of federally sponsored research or development.

BACKGROUND OF THE INVENTION

The present invention relates to water coolers, including, but not limited to, a cooling container that holds a cooling medium for use in the indirect cooling of bottled drinking water. Devices and methods for cooling drinking water, particularly for supplying cooled uncontaminated drinking water, are known. Typically, water coolers include a reservoir that receives drinking water from a water bottle and a refrigeration system that cools the drinking water in a reservoir. Because the exterior of a water bottle can become contaminated through handling or exposure to the environment, some water coolers use a hygienic seal between the cooler and the water bottle. The hygienic seal includes a plug in a water bottle outlet that cleans and seals against a feed tube of the cooler so as to reduce possible contamination of the drinking water. The feed tube is connected to a sealed reservoir. When a water bottle is placed in the water cooler, the feed tube penetrates and seals against the plug at the water bottle outlet. For these types of cooler, the refrigeration system that cools the reservoir and the contained drinking water is typically powered by an electric motor. Because of the electric power requirement, these types of water coolers are most commonly found inside and near buildings and structures that have easy access to electric power.

For more remote supply of cool drinking water, such as on a golf course, a source of power to drive a refrigeration system may not be readily available. Often water coolers located at remote outside locations include a single insulated container or cooler. Cool drinking water is produced by commingling drinking water from a water bottle or other purified source and ice. The water and the ice are simply mixed together in the container that is opened to ambient conditions. Opening the cooler to ambient conditions, handling the cooler, and handling the ice and water that are charged to the cooler often results in the contamination of the drinking water. For example, physical handling of ice and water by a golf course grounds crew member can result in cooled, but contaminated drinking water. To avoid contamination of drinking water, some remote water cooling systems use a system of plastic bags. The plastic bags are filled with drinking water and placed inside a container. The container is subsequently filled with ice so as to surround the water bag with ice. Remote water coolers that use plastic bags full of water require reuse of the bags which includes the time consuming and costly cleaning of the plastic bags. In addition, contact of the plastic bags by water contaminated through the handling and loading of ice cubes charged to the cooler can result in drinking water contamination.

Accordingly, there is a need for a drinking water cooler that can indirectly cool drinking water without the need for electric driven refrigeration, yet prevents the drinking water from becoming contaminated during the refilling of the water source and the cooling medium, for example ice, and is easy to use.

BRIEF SUMMARY OF THE INVENTION

An apparatus includes a reservoir having a feed tube that is capable of receiving and engaging a hygienic seal on a water bottle, and a conduit mounted inside a cooling container that contains a cooling medium, such as ice. The conduit is externally cooled and can indirectly cool drinking water that passes through the conduit so that the drinking water is not contaminated by contact with the cooling medium or ambient conditions.

DETAILED DESCRIPTION OF THE PREFERRED EMBODIMENT

The following describes an apparatus for and method of delivering cooled and uncontaminated drinking water from a water cooler. The cooler includes a reservoir that receives drinking water from a water bottle, and a conduit that is contained in a container that holds a cooling medium such as ice. The conduit permits the indirect cooling of the drinking water from the reservoir so as to prevent contamination of the drinking water.

Figure 1:
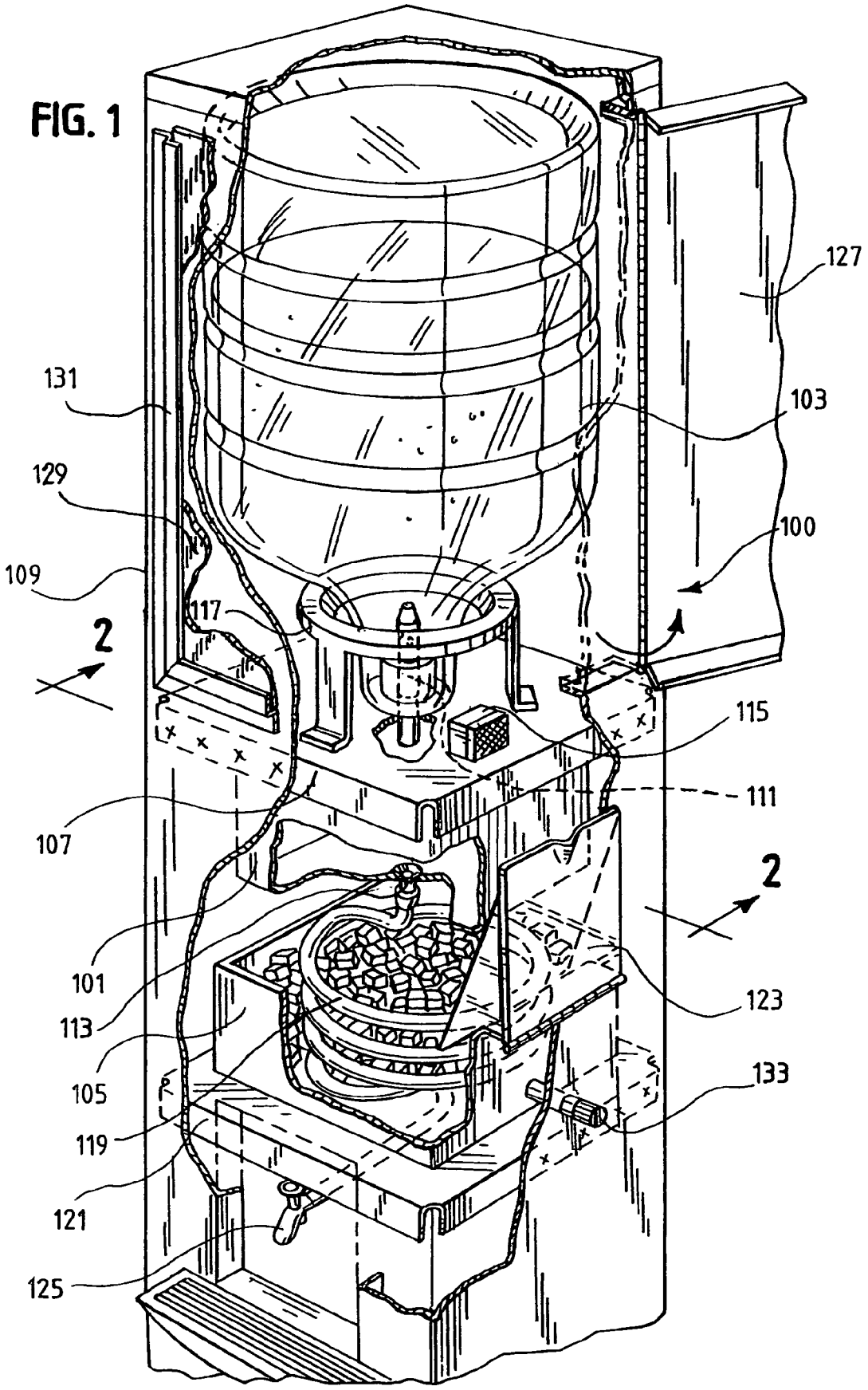
FIG. 1 illustrates a water cooler that minimizes the potential for drinking water contamination through the indirect cooling of water supplied from a water bottle in accordance with the invention.

A water cooler 100 that minimizes the potential for drinking water contamination through the indirect cooling of water supplied from a water bottle is as shown in FIG. 1. The water cooler 100 includes a reservoir 101 that receives drinking water from a water bottle 103 and a cooling container 105 that holds ice used to cool the drinking water. The water bottle 103 is a commercially available water bottle that has a hygienic seal at the bottle outlet as commonly known in the industry. Generally, water bottles are made of rigid material, such as see-through or clear plastic; however, water bottles formed from non-rigid and non-transparent materials are also commonly available. In the preferred embodiment, the reservoir 101 is formed as part of and below a water bottle shelf 107 that is mounted inside a cooler housing 109. The reservoir 101 has a feed tube 111, a discharge 113, and a breather inlet 115. In the preferred embodiment, the feed tube 111 and the breather inlet 115 are mounted to the water bottle shelf 107 and extend into the reservoir 101. A bottle support 117 mounted on top of the water bottle shelf 107 supports the water bottle 103 such that a hygienic seal (not shown) at the water bottle outlet can be penetrated by and engaged with the feed tube 111.

The reservoir discharge 113 is mounted through a bottom surface of the reservoir 101 and is connected to a conduit 119 that is supported inside the cooling container 105. Preferably, the bottom portion of the reservoir 101 is formed to facilitate the proper drainage of water in the reservoir 101 towards the discharge 113. In the preferred embodiment, a sufficient length of conduit 119, for example FDA grade hose, is coiled inside the cooling container 105 so that drinking water that passes through the conduit can be cooled. The cooling container 105 is supported on a cooler shelf 121 that is attached to the inside of the housing 109, and the cooling container 105 is open on top to facilitate the loading of a cooling medium such as ice. A side of the cooler 100 can have a door-like ice chute 123 that is proximately close to the cooling container 105 so that a cooling medium such as ice can be loaded into the cooling container 105. The conduit 119 also connects to a spigot 125 for dispensing cool drinking water. Preferably, the spigot 125 is mounted in a recessed portion of the housing 109. The cooler 100 can be designed so that both ends of the conduit 119 extend through the top of the cooling container. Alternately, one or both ends of the conduit can be mounted through the walls of the cooling container 105. Preferably, a drain 133 that can be controlled by either a cap or a valve is located at the bottom of the cooling container 105.

The water bottle 103 is loaded into the upper section of the cooler 100 by opening an access door 127 mounted in the housing 109. Alternatively, the access door 127 can provide access to both the water bottle 103 and the cooling container 105 for loading ice. Preferably, the access door has a lock to prevent unauthorized access inside the cooler. In the embodiment of the invention, the bottom of the cooler is an empty volume below the cooler shelf 121. Alternatively, the bottom section of the cooler can be designed to store either empty or replacement water bottles that can be accessed through a lower door.

At least one placard 129 is mounted in a placard holder 131 attached to the outer surface of the housing 109. Alternatively, placards can be secured directly to housing with adhesive. The placards can provide a variety of information such notices, instructions on how to use the cooler, benefits of the cooler, advertisements, and so forth.

The cooler 100 and any or all of its components can be formed from either metal or plastic or both. Components that are in contact with the drinking water, more specifically the housing 109, the reservoir 101, the cooling container 105, and the conduit 119, are preferably formed from FDA approved materials. The cooling container 105 can be formed from insulating material. Alternatively, the cooling container 105 can be formed from a plurality of layered materials wherein at least one layer is insulation.

Figure 2:
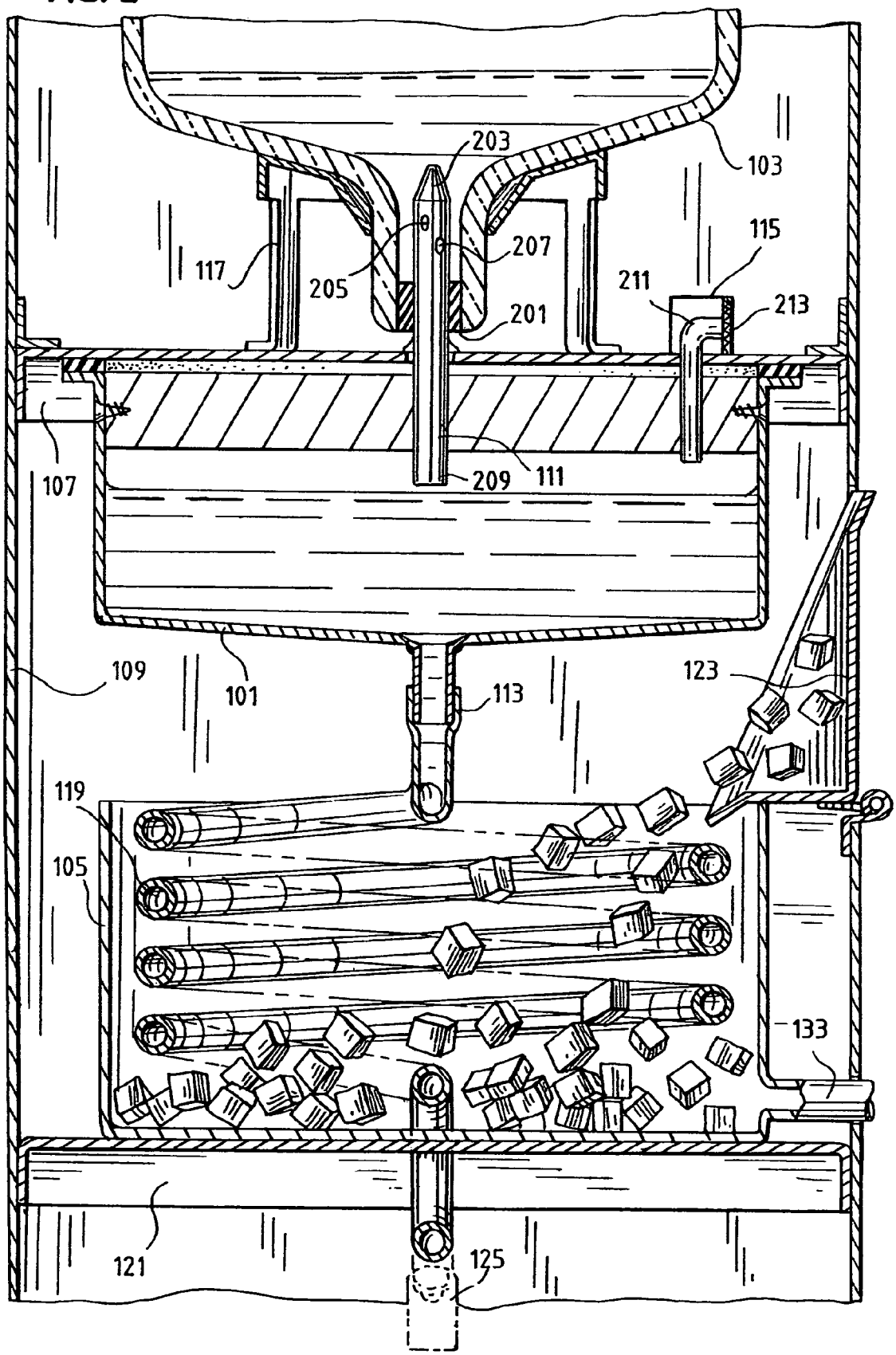
FIG. 2 illustrates a cross-section of a water cooler for use in the indirect cooling of drinking water in accordance with the invention.

A cross-section of a water cooler for use in the indirect cooling of drinking water is shown in FIG. 2. A water bottle 103 is loaded into the cooler 100 and supported on the bottle support 117 such that a hygienic seal 201 at the water bottle outlet, as known in the bottled water industry, can be penetrated by and engaged with the feed tube 111, preferably having a generally cylindrical shape and a smooth outer surface. To facilitate the penetration of the hygienic seal 201, the feed tube 111 has a tapered end 203. The hygienic seal 201 and the feed tube 111 can be formed so that the hygienic seal slips over the feed tube. Preferably, the hygienic seal provides a cleansing of the feed tube as the hygienic seal slips over the feed tube. Alternately, the hygienic seal and feed tube can be formed with tabs and complementary grooves so that the hygienic seal and feed tube releasably snap lock together.

To facilitate the exchange of air and water during the emptying of the water bottle, at least one air passage 205 and at least one liquid passage 207 in the feed tube 111 are disposed near the tapered end 203. The passages provide different flow paths for the counter current flow of air and water although the simultaneous flow of water and air can occur in at least one passage during cooler operation. Preferably, at least one pair of passages is used such that a first passage is positioned at a lower elevation and off-centered from a second passage.

During operation of the cooler 100, water from the water bottle 103 flows into the reservoir 101 through the feed tube 111. When water from the water bottle 103 enters the reservoir 101 and air is displaced and passes up through the feed tube 111 and into the water bottle. The exchange of water into and air out of the reservoir continues until the water level in the reservoir 101 is sufficiently above the second end 209 of the feed tube 111.

As cooled drinking water is dispensed from the spigot 125 the water level in the reservoir 101 drops relative to the second end 209 of the feed tube 111. Once the water level is low enough, and particularly when the water level is below the second end 209, air in the reservoir 101 begins to pass up through the feed tube 111 and into the water bottle. Simultaneously, water is discharged from the water bottle through the feed tube 111 and into the reservoir 101, such that there is an exchange of air and water. The exchange of air and water continues until the water level in the reservoir 101 is again sufficiently above the second end 209 of the feed tube 111.

The air that leaves the reservoir 101 and enters the water bottle 103 is replaced with outside air. Outside air enters the reservoir 101 through a breather inlet 115. Air within the breather inlet 115 is in communication with the air trapped within the upper portion of the reservoir 101 through the breather tube 211 which allows air to enter or exit the reservoir 101 during cooler operation. Ambient air surrounding the cooler is draw into the breather inlet 115. Preferably, a filter 213, for example a small micron filter that can remove containment from the air in order to preserve drinking water purity, is mounted in the breather inlet 115 so that the ambient air is filtered before entering the cooler 100. Alternatively, the filter can be part of the breather tube 211 so that any air passing through the breather tube is filtered, and thus eliminating the need for the breather inlet 115.

During cooler operation, water in the reservoir 101 exits through the discharge 113 and into a conduit 119 that is immersed in a cooling medium that is contained within the cooling container 105. Preferably, the cooling medium is ice or an ice/water combination. Alternatively, the cooling medium can include dry ice and so forth provided that the cooling container 105 and conduit 119 are designed so as to prevent the freezing of drinking water in the conduit 119. The cooling medium indirectly cools the drinking water as the drinking water passes through the conduit 119. As needed, the cooling medium can be replaced or supplemented as the cooling medium losses effectiveness. For example when the cooling medium is ice, the water produced by melted ice can be drained from the cooling container 105 by opening the drain 133, and more ice can be added to the cooling container 105 through the supply chute 123.

Figure 3:
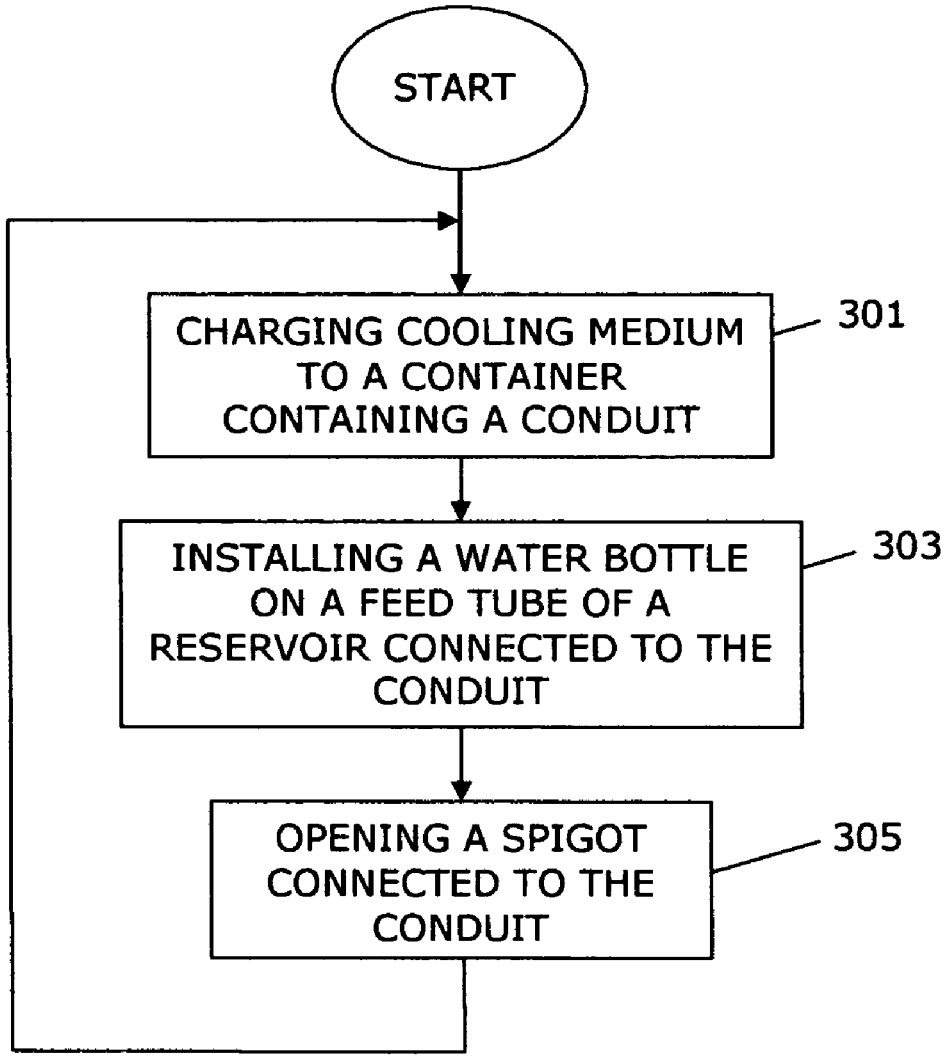
FIG. 3 is a flow diagram of a method for delivering cool drinking water that has a reduced potential of contamination in accordance with the invention.

A flow diagram of a method for delivering cool drinking water that has a reduced potential of contamination is as shown in FIG. 3. At step 301, a cooling medium, for example ice, is charged to the container 105 within the cooler 100 that contains the conduit 119 inside which water passes. At step 303, a water bottle 103 is installed on a feed tube 111 such that the water bottle hygienic seal 201 is penetrated by and engaged with the feed tube 111. The water bottle can be formed from rigid and non-rigid materials, but preferably is formed to be easily supported in position on the feed tube. With the water bottle 103 supported to engage the feed tube 111, water can flow from the water bottle 103 into the reservoir 101. At step 305, a spigot 125 that is connected to the reservoir 101 through a conduit 119 that is externally cooled by the cooling medium contained in the container 105 is opened to dispense cooled drinking water. When ice is used as the cooling medium, over time the ice will melt to form water that can be periodically drained from the container 105.

Although the present invention is illustrated by the example of water supplied in rigid and non-rigid water bottles that is cooled indirectly by ice, the present invention may be applied to: other beverages such as milk, carbonated drinks, fruit drinks, and so forth; and the cooling medium that can include ice, water, dry ice, and so forth either individually or in combination.

The present invention provides a number of advantages, including the ability to reduce the potential of contamination of cooled drinking water that is supplied in remote locations. The present invention provides a cooler that cools commercially available bottled water, yet does not require electric power. Indirect cooling of drinking water allows the use of inexpressive cooling medium such as ice at remote locations. The present invention reduces the need to install bag cleaning facilities that are required for plastic bag systems. The present invention can use commercially available and recyclable water bottles and reduces the time and cost associated with retrieving and cleaning water bags used with plastic bag systems. Thus, the cost to supply cooled drinking water can be reduced while simultaneously the potential for drinking water contamination is also reduced.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An apparatus comprising:

a reservoir having a feed tube, an outlet, and an air inlet, wherein the feed tube is capably of receiving and engaging a hygienic seal of a water bottle such that a inner volume of the reservoir is in communication with an inner volume of the water bottle; and a conduit having a fist end connected to the reservoir outlet and a second end connected to a spigot, wherein the conduit is mounted inside a container that contains a cooling medium that is capable of cooling water that flows from the reservoir and through the conduit when the spigot is opened.

2. The apparatus of claim 1, further comprising a filter mounted proximately close to the air inlet such that the filter is capable of filtering air that passes through the air inlet.

3. The apparatus of claim 1, further comprising a drain attached to a bottom portion of the container.

4. The apparatus of claim 1, wherein the container has an opening on a top portion of the container for use in loading the cooling medium into the container.

5. The apparatus of claim 1, further comprising a bracket mounted above the reservoir, wherein the bracket is capable of supporting a water bottle.

6. The apparatus of claim 1, wherein at least a portion of the apparatus is formed from metal.

7. The apparatus of claim 1, wherein at least a portion of the apparatus is formed from plastic.

8. The apparatus of claim 1, wherein at least a portion of the apparatus is formed from thermally insulating material.

9. An apparatus comprising:

a housing having a first compartment capable of receiving and supporting a water bottle, and a second compartment capable of receiving a cooling medium into a container, and a spigot;

a reservoir having a feed tube, an outlet, and an air inlet, wherein the feed tube is capably of receiving and engaging a hygienic seal of the water bottle; and a conduit having a first end connected to the reservoir outlet and a second end connected to the spigot, wherein the conduit is mounted inside a container that contains the cooling medium.

10. The apparatus of claim 9, further comprising a filter mounted proximately close to the air inlet such that the filter is capable of filtering air that passes through the air inlet.

11. The apparatus of claim 9, further comprising a discharge mounted in a bottom of the container for use in draining liquids from the container.

12. The apparatus of claim 9, further comprising a chute mounted in a side of the housing proximately close to the container.

13. The apparatus of claim 9, further comprising a bracket mounted in the first compartment, wherein the bracket supports an end of the bottle having the hygienic seal that is positioned on the feed tube.

14. The apparatus of claim 9, further comprising at least one placard attached to an exterior surface of the housing.

15. The apparatus of claim 14, wherein the placard is an advertisement.

16. The apparatus of claim 9, wherein at least a portion of the apparatus is formed from metal.

17. The apparatus of claim 9, wherein at least a portion of the apparatus is formed from plastic.

18. The apparatus of claim 9, wherein at least a portion of the apparatus is formed from thermally insulating material.

19. A method comprising the steps of:

charging a cooling medium to a container that contains a conduit that is connected to a reservoir and a spigot;

installing a drinking water bottle having an outlet on a feed tube of the reservoir; and opening a spigot that causes drinking water to flow from the reservoir through the conduit.

20. The method of claim 19, wherein the water bottle is formed from rigid material.

21. The method of claim 19, wherein the water bottle is formed from non-rigid material.

22. The method of claim 19, wherein the cooling medium comprises ice.

23. The method of claim 22, further comprising the step of draining water from the container.

* * * * *